US007963519B2

(12) United States Patent
Bokelman et al.

(10) Patent No.: US 7,963,519 B2
(45) Date of Patent: Jun. 21, 2011

(54) MEDIA PICK SYSTEM AND METHOD

(75) Inventors: Kevin Bokelman, San Diego, CA (US); Glenn W. Gaarder, Ramona, CA (US); Ryan M. Smith, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 998 days.

(21) Appl. No.: 11/604,503

(22) Filed: Nov. 27, 2006

(65) Prior Publication Data

US 2008/0122162 A1 May 29, 2008

(51) Int. Cl.
*B65H 3/06* (2006.01)

(52) U.S. Cl. ..... 271/117; 271/118

(58) Field of Classification Search ..... 271/114, 271/117, 118

See application file for complete search history.

(56) References Cited

U.S. PATENT DOCUMENTS

| | | | | |
|---|---|---|---|---|
| 5,193,797 | A * | 3/1993 | Harada et al. | 271/115 |
| 5,449,161 | A | 9/1995 | Gysling | |
| 5,453,852 | A | 9/1995 | Morikawa et al. | |
| 5,462,267 | A * | 10/1995 | Hori | 271/10.04 |
| 5,606,430 | A | 2/1997 | Morikawa et al. | |
| 5,775,823 | A * | 7/1998 | Bekki et al. | 400/629 |
| 6,032,946 | A | 3/2000 | Marshall et al. | |
| 6,382,619 | B1 | 5/2002 | Gustafson et al. | |
| 6,457,707 | B1 | 10/2002 | Hendrix et al. | |
| 6,540,219 | B1 | 4/2003 | Naruse et al. | |
| 6,877,736 | B2 | 4/2005 | Chung | |
| 6,991,392 | B2 | 1/2006 | Hult et al. | |
| 7,004,460 | B2 | 2/2006 | Ruhe et al. | |
| 2004/0021264 | A1 * | 2/2004 | Gaarder et al. | 271/117 |
| 2004/0155397 | A1 * | 8/2004 | Gaarder et al. | 271/10.11 |
| 2005/0194733 | A1 | 9/2005 | Asada | |
| 2006/0043664 | A1 * | 3/2006 | Park | 271/9.05 |

* cited by examiner

*Primary Examiner* — Stefanos Karmis
*Assistant Examiner* — Thomas A Morrison

(57) ABSTRACT

Various embodiments of a system and method for picking print media are disclosed.

12 Claims, 10 Drawing Sheets

MEDIA PICK SYSTEM AND METHOD

BACKGROUND

The present disclosure relates generally to media pick and separation systems that are used in image forming devices, such as printers, copiers, facsimile machines and the like. These types of image forming devices typically include a feed mechanism that supplies individual sheets of print media (e.g. paper) onto which images are formed. Many such image forming devices include a tray that stores an input stack of sheets of print media, and a pick mechanism is used to pick the top sheet off of the input stack and advance the sheet to the feed mechanism.

One type of pick mechanism includes a rotating pre-pick roller that is attached to an end of a pick arm. The pre-pick roller is brought into and out of engagement with the top of the stack at an appropriate time through rotation of the pick arm. Upon contacting the top of the input stack, the pre-pick roller frictionally engages the top sheet on the stack and urges the sheet forward to the pick roller and the other portions of the feed mechanism.

During the pick process, it is desirable to maintain the magnitude of the normal force exerted onto the stack by the pre-pick roller within a predefined range so that the pre-pick roller will properly engage the top sheet in the stack. If the magnitude of the normal force is too low, the pick roller will not be able to frictionally engage the top sheet. If the magnitude of the normal force is too high, multiple sheets may be fed and back tension can be created. Additionally, the mechanism that rotates the pick arm can impose a parasitic drag on the printer system, which places a drag on motor torque.

BRIEF DESCRIPTION OF THE DRAWINGS

Various features and advantages of the invention will be apparent from the detailed description which follows, taken in conjunction with the accompanying drawings, which together illustrate, by way of example, features of the invention, and wherein.

DETAILED DESCRIPTION

Figure 1A:
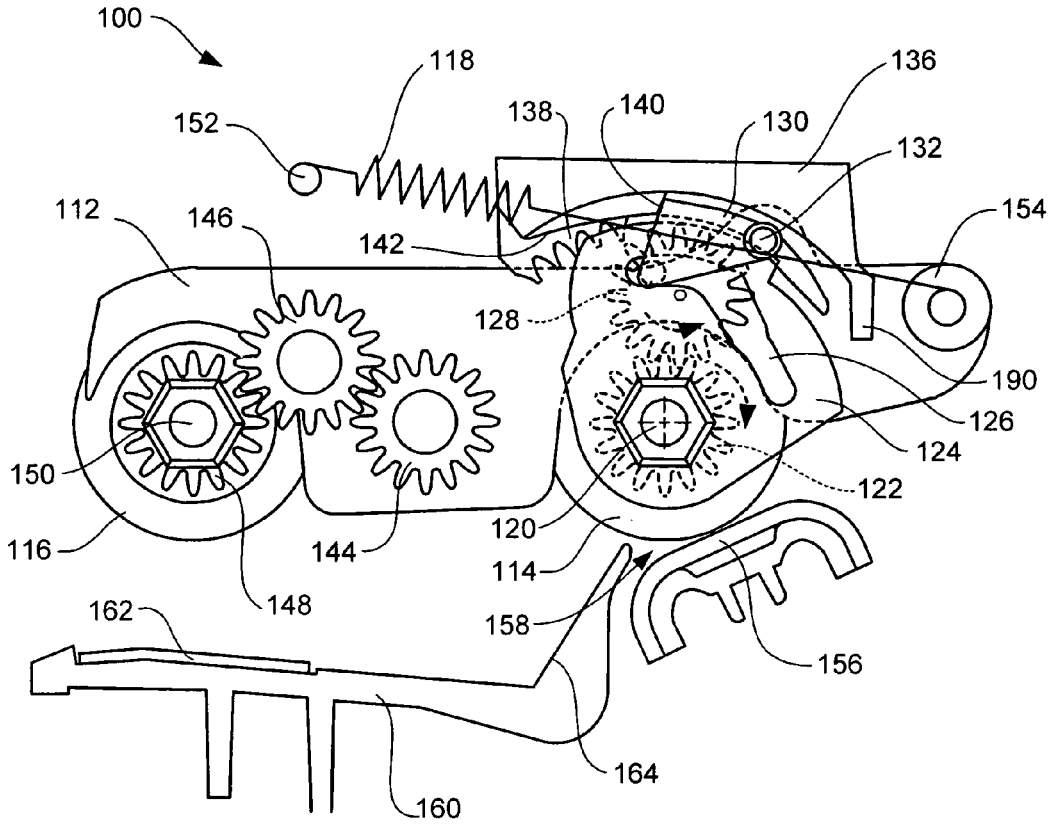
FIG. 1A is a side view of one embodiment of a pick arm of a paper pick and separation system in accordance with the present disclosure, with the pick arm in the fully up and freewheeling position.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

Paper pick and separation systems can be susceptible to a number of undesirable characteristics that impair their consistency and effectiveness. First, the normal force that is imposed upon the media can vary depending upon the deflection angle of the pick arm. The deflection angle is the angle of downward rotation of the pick arm about its pivot point relative to the horizontal. An example of a deflection angle a1 is shown in the free body diagram of FIG. 10A. A change in the normal force due to the deflection angle can be due to both the geometry of the pick arm and to a counter-rotational force created through friction with the paper stack. When the stack is large and the rotation angle of the pick arm to the engaged position is small, the normal force on the pick roller can be high enough to potentially cause a double pick (i.e. picking two or more sheets at once). Conversely, when the stack is very small (only a few sheets) and the angle is relatively large, the normal force can drop and be insufficient to properly pick the top sheet from the stack. Because of this potentially wide variation in normal force with pick arm angle, the capacity of the paper tray can be limited so that the angular deviation from a large stack to the final sheet is relatively small.

Additionally, if the mechanism for providing the torque to rotate the pick arm is inconsistent in the amount of torque it imparts, this can introduce an additional source of variation in the normal force imposed upon the media stack. Finally, some pick arm rotation mechanisms can impose a parasitic drag on the system, which places a drag on motor torque. This can lead to an increased initial cost for the device by requiring a larger motor, and increased operating cost due to higher power consumption.

Advantageously, the inventors have devised a media pick system that provides several advantageous features. This pick system helps provide a more constant and repeatable normal force for the pre-pick roller throughout a range of input stack sizes, and also develops the pre-pick normal force with reduced parasitic drag on the system. The resulting design provides a positively actuated pick system using an extension spring attached to the pick arm in such a way as to create a more constant normal force at the pre-pick roller. A selectively engageable retraction mechanism restrains the spring force to lift the pick arm back to a disengaged position to allow paper to be loaded into the input tray. The retraction mechanism uses a swing arm, called a shuttle, which engages with an internal gear, driving the pick arm up and allowing a trigger to catch and hold the arm up. Reversing the shuttle disengages the trigger and allows the pick arm to be pulled down under the force of the extension spring.

A side view of one embodiment of a pick arm of a paper pick and separation system in accordance with the present disclosure is provided in FIG. 1A. The pick arm assembly 100 generally includes a pick arm 112, a pick roller 114, a pre-pick roller 116, and a tension spring 118. As with the prior pick arm assembly (shown in FIG. 1A), the pick arm pivots about a drive shaft or input shaft 120 of the pick roller.

Figure 2:
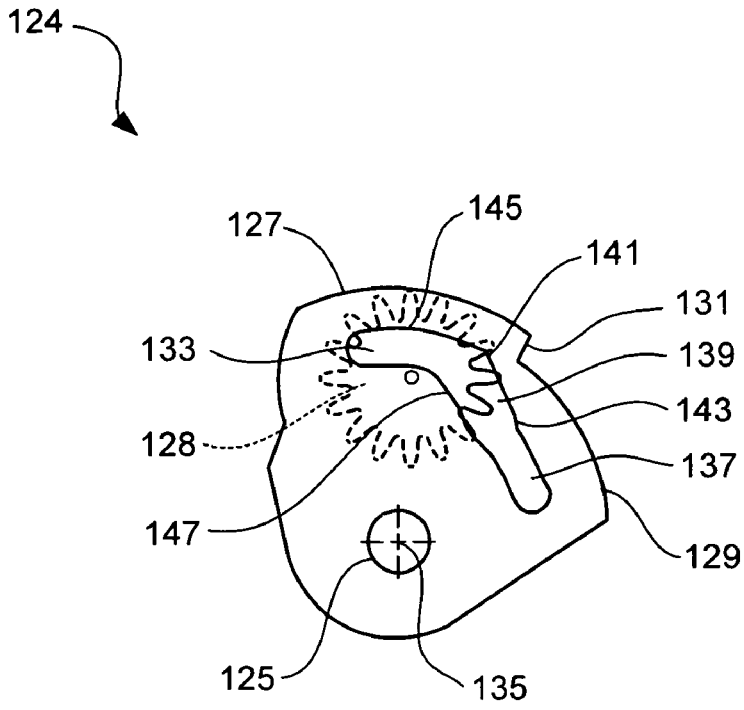
FIG. 2 is a view of the shuttle.

A pick roller drive gear 122 is affixed to the drive shaft 120 and rotates with the drive shaft and pick roller 114. A shuttle 124 is pivotally slidingly mounted upon the drive shaft in front (from the viewpoint of FIG. 1A) of the pick roller drive gear. The shuttle is basically a flat plate of material (e.g. plastic) that includes an irregular arcuate cam slot 126. A view of the shuttle itself is shown in FIG. 2. The shuttle generally includes a hole 125 for mounting over the drive shaft, an outer cam surface 127 along the upper edge, an inner cam surface 129 also located along the upper edge, and a shoulder 131 between the outer and inner cam surfaces. The cam slot includes a forward curved section 133 (having a substantially constant radius with respect to the center 135 of the hole 125), and a rearward curved section 137 (having a substantially constant radius that is less than the radius of the forward curved section), with a widened section 139 (having a variable radius) therebetween. A first bend 141 transitions from the forward curved section to the widened section, and a second bend 143 transitions from the widened section to the rearward curved section. The top edge 145 and bottom edge 147 of the cam slot provide cam surfaces, the operation of which is described below. Because the shuttle is not affixed to the drive shaft, the shuttle can pivot upon the drive shaft while the drive shaft turns at some different rate. The fit between the hole of the shuttle and the drive shaft is configured to provide a small amount of friction between the rotating drive shaft and the shuttle, for reasons that are discussed below.

Pivotally attached to the back side of the shuttle (from the point of view of FIGS. 1A, 1B and 2) is a planet gear 128 that is positioned to engage the pick roller drive gear (122 in FIG. 1A). Whenever the drive shaft 120 rotates, the pick roller drive gear will cause the planet gear to rotate in an opposite direction.

Figure 3:
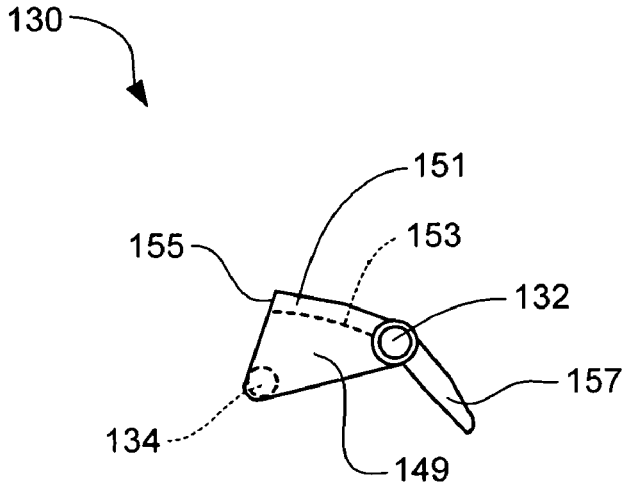
FIG. 3 is a view of the trigger.

A trigger 130 is pivotally attached to the pick arm 112 at a pivot point 132. A view of the trigger by itself is provided in FIG. 3. The trigger includes a substantially vertical body 149, to the back side of which is attached a follower pin 134. The follower pin is configured to ride in the cam slot 126, as shown in FIG. 1A. The trigger also includes an upper horizontal portion 151 that extends from the back of the body, and includes a lower shoulder surface 153. The forward end of the upper horizontal portion includes a nose 155, and the trigger also includes a tail 157, extending from the pivot in a direction opposite the main body of the trigger.

Referring back to FIG. 1A, disposed above the pick arm 112 is a ring gear/latch assembly 136. The ring gear/latch assembly includes a ring gear segment 138, a catch 140, and a curved shoulder 142. The entire ring gear/latch assembly is attached to the support structure of the image forming device and remains stationary with respect to the support structure. The center of curvature of the ring gear segment is the center of the drive shaft 120. The ring gear segment is configured to selectively engage with the planet gear 128, as described more fully below. The catch is configured to receive the nose 155 of the trigger 130 in the latched position (the position shown in FIG. 1A), and the shoulder 142 acts as a ramp to guide the trigger from the released position back to the engaged position, as described below.

The pick arm 112 also includes a first idler gear 144 that is engaged with a second idler gear 146, which is in turn engaged with the pre-pick roller drive gear 148. The first and second idler gears and the pre-pick roller drive gear are collectively referred to as the pre-pick roller drive train. The pre-pick roller drive gear is affixed to the pre-pick roller shaft 150, and rotates with the pre-pick roller. The pick roller drive gear 122, the planet gear 128, the ring gear segment 138 and the pre-pick roller drive train are oriented in a substantially common plane, and together provide a positively actuated drive train for the pre-pick roller. The manner of their operation is described in detail below.

Disposed around the pivoting pick arm 112 are a number of other fixed structures. Located above the pick arm and approximately above the second idler gear 146 is a fixed attachment point 152 for the tension spring 118. The opposite end of the tension spring is attached to a rear extension 154 of the pick arm. The spring attachment point and the center of the drive shaft 120 are attached to the support structure of the image forming device, and are thus in fixed positions with respect to each other, as is the ring gear/latch assembly 136.

Looking at other fixed structures associated with the image forming device, a pick roller separation pad 156 is positioned directly opposite and in contact with the pick roller 114. Individual sheets of print media are drawn through the nip 158 that is created between the pick roller and the separation pad. The materials of the pick roller and the separation pad are chosen so that friction between the pick roller and the print media is higher than friction between the print media and the separation pad, which in turn is higher than friction between adjacent sheets of the print media. It is desirable that this hierarchy of frictional forces continue throughout the life of the paper pick system and regardless of environmental conditions. This condition helps promote consistent picking of the media, while also preventing multiple sheets from being picked.

Below the pick arm 112 is a print media tray 160, which provides a storage location for the print media stack (186 in FIG. 7A) and also places the stack in proper relation to the pick arm to allow picking of the sheets. The print media tray is designed to have some maximum capacity (i.e. maximum allowable thickness of the stack), which consequently determines the maximum angular deflection of the pick arm and the range of angles at which the pick arm is designed to operate. The media tray also includes a cork pad 162, which provides a surface that promotes effective picking of the sheets of media. As with the pick roller 114, the materials of the pre-pick roller 116 and the cork pad are chosen so that friction between the pre-pick roller and the print media is higher than friction between the print media and the cork pad, which in turn is higher than friction between adjacent sheets of the print media. This helps the pre-pick roller to effectively pick the last sheets of media from a stack throughout the life of the paper pick system.

The far end of the media tray 160 includes a stop 164. Upon contacting the top of the input stack (186 in FIG. 7A), the pre-pick roller 116 will frictionally engage the top sheet on the stack and urge the sheet against the stop. This causes the top sheet to buckle and separate from the remainder of the stack. The upward angle of the stop urges the sheet of media toward the pick roller nip 158.

The operation of the pick arm assembly 100 is illustrated in the sequential views of FIGS. 1A-1B and 4A-9B. The rotation of the rollers, gears, and the pick arm itself are indicated with arrows throughout these figures. In the position shown in FIG. 1A, the trigger 130 is engaged and locked into the catch 140 that is molded into the ring gear/latch assembly 136, thus holding the pick arm 112 up and stationary. In this position the planet gear 128 is not engaged with the ring gear segment 138, and is thus allowed to rotate freely counter clockwise as the drive shaft 120 and pick roller gear 122 rotate clockwise. This is the indefinite dwell period, in which the drive shaft can spin clockwise as long as desired for initialization of the image forming device or for other purposes. It should also be noted that a directional clutch (not shown) can be provided between the drive shaft and the pick roller 114 to cause the pick roller to rotate only when the drive shaft rotates in the counter clockwise direction. With a directional clutch, when the drive shaft rotates clockwise, as in FIG. 1A, the pick roller does not rotate. However, the pick roller drive gear does rotate with the drive shaft in both directions, and thus drives the planet gear when the drive shaft rotates clockwise.

Figure 1B:
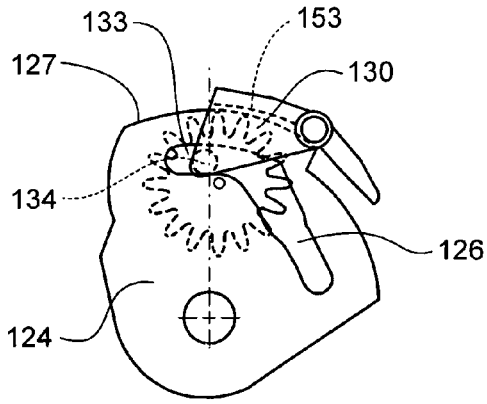
FIG. 1B is a view of the relative positions of the shuttle and trigger when the pick arm assembly is in the position shown in FIG. 1A.

Referring to FIG. 1B, in this position the trigger 130 is held up into the catch by the outer cam surface 127 of the shuttle 124, which presses against the lower surface 153 of the trigger shoulder 151. This cam surface is the outermost diameter of the shuttle relative to its center of rotation 135. This cam surface prevents the trigger from dropping and allowing the pick arm to drop into the pick position. The follower pin 134 is positioned in the forward curved section 133 of the cam slot 126 toward the right end of the outer cam surface, the shuttle shoulder 131 is configured to contact a mating stop in the trigger (not shown). This stop prevents further clockwise rotation of the shuttle (from the position shown in FIG. 1A) as the drive shaft 120 continues to rotate clockwise.

Figure 4A:
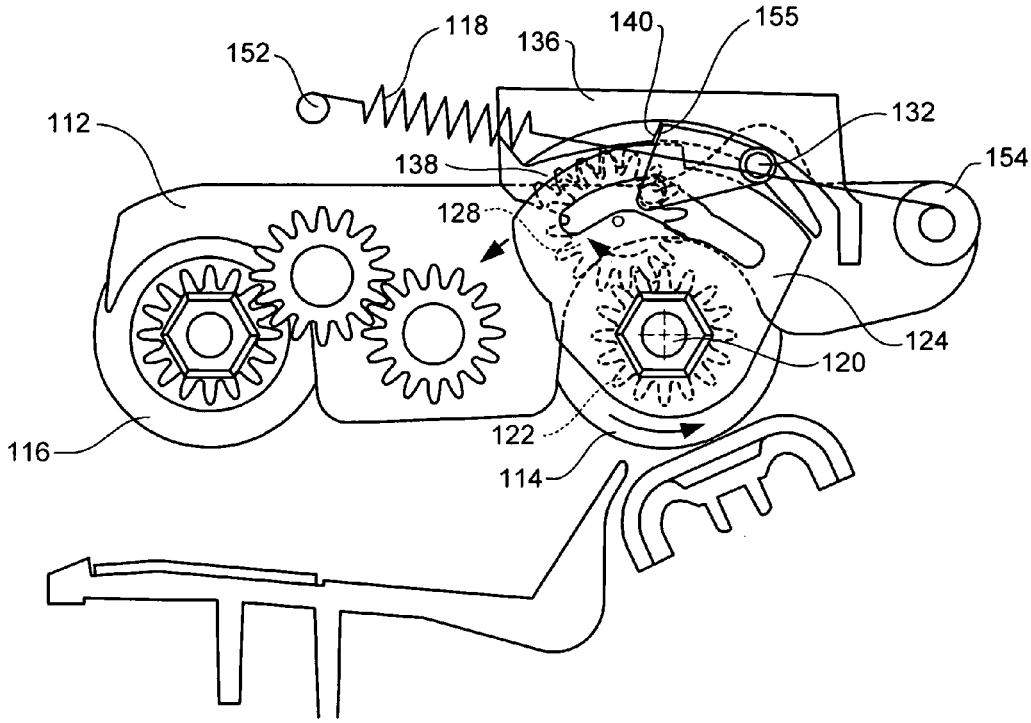
FIG. 4A is a side view of the pick arm of FIG. 1 with the planet gear engaging with the ring gear segment at the beginning of the downward motion sequence.
Figure 4B:
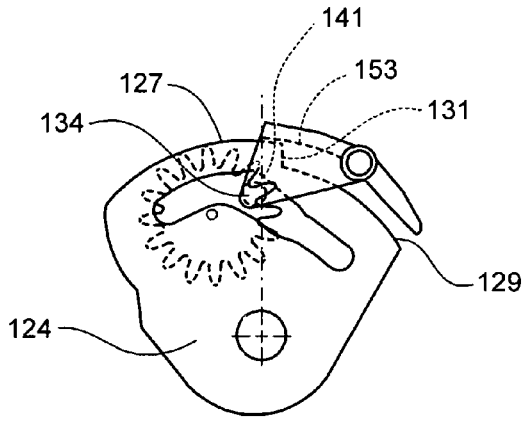
FIG. 4B is a view of the relative positions of the shuttle and trigger when the pick arm assembly is in the position shown in FIG. 4A.

Shown in FIGS. 4A and 4B is the beginning of the downward motion sequence, with the planet gear 128 beginning to engage the ring gear segment 138. When it is desired to lower the pick arm 112 to pick sheets of media from a stack, the drive shaft 120 of the pick roller is driven to rotate counterclockwise, which in turn rotates the planet gear clockwise, and, through light friction between the shuttle 124 and the drive shaft, causes the shuttle to rotate slightly counter-clockwise, allowing the planet gear to engage the ring gear 138. The light drag between the drive shaft and the shuttle predisposes the shuttle to rotate with the drive shaft (counter clockwise away from the stop on the trigger 130) and place the planet gear into position to engage with the ring gear segment.

Referring to FIG. 4B, as the shuttle 124 rotates counter clockwise, the follower pin 134 on the trigger 130 rides in forward portion 133 of the cam slot 126 until reaching the first bend 141 in the slot. This is the condition shown in FIGS. 4A and 4B. At this point the trigger is still engaged with the catch (140 in FIG. 4A), and the pick arm 112 is in the up and locked position. As noted above, the forward section of the cam slot is substantially radial, so as not to have significant friction with the follower pin and thus not create any substantial resistive drag against movement of the shuttle. This allows the friction between the drive shaft 120 and the shuttle to remain rather low, and therefore not significantly parasitic, while still being sufficient to rotate the shuttle to the position at which the planet gear 128 and ring gear 138 will engage. Once the planet gear engages the ring gear, positive driving force from the drive shaft will cause the shuttle to continue to rotate counterclockwise, without further dependence on friction.

During this stage, as shown most clearly in FIG. 4B, the outer cam surface 127 of the shuttle 124, which keeps the nose 155 of the trigger 130 engaged with the catch 140, moves clear of the trigger stop, and the follower pin 134 moves toward the wider central portion 139 of the cam slot 126. Once the shuttle shoulder 131 moves past the position of the nose of the trigger, the trigger can drop down to allow the pick arm to be released. This is the condition shown in FIGS. 5A and 5B. As shown most clearly in FIG. 5B, when the trigger 130 drops down, the lower surface 153 of the shoulder 151 drops off of the outer cam surface 127 of the shuttle 124, and comes to rest upon the inner cam surface 129 of the shuttle, with the nose 155 of the trigger abutting the shoulder 131 of the shuttle.

The geometry of the trigger 130 and catch 140 can be based upon the frictional characteristics of the materials of these parts. For example, in one embodiment, the surface of the catch can be at an angle that is 15 degrees off from the line of action thru the trigger pivot, that is, 15 degrees off of a line running radially from the center of rotation (135 in FIG. 2) of the shuttle 124. For the materials chosen for this specific embodiment, this angle is greater than the arctangent of the coefficient of friction (atan(μ)) between the trigger and the catch surfaces. When a surface is angled more than the arctangent of the coefficient of friction from the line of force, sliding will be induced because the tangential force will then exceed the resistive frictional force. Designed in this way, the trigger is predisposed to "pop" out of the catch and drop down onto the inner cam surface 129 of the shuttle 124, while the follower pin 134 drops into the wider center portion 139 of the cam slot 126.

Figure 5A:
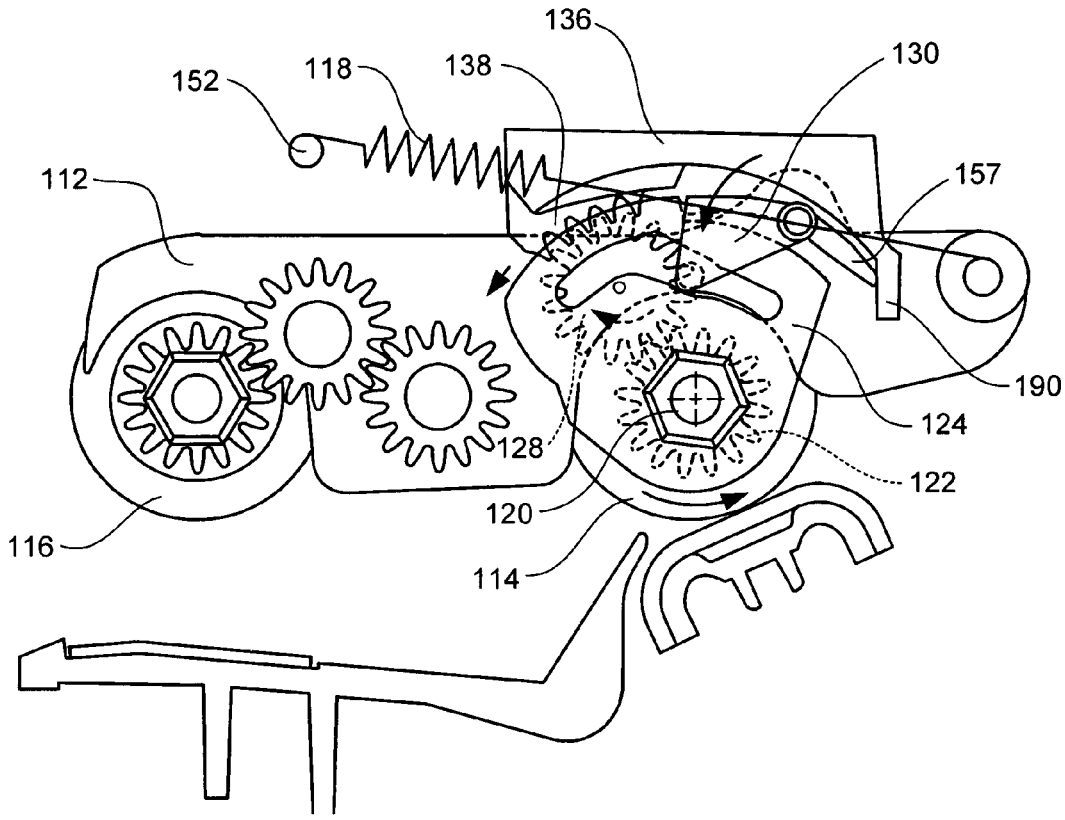
FIG. 5A is a side view of the pick arm of FIG. 1 at the instant that the trigger is pulled down, but before downward motion of the pick arm has commenced.
Figure 5B:
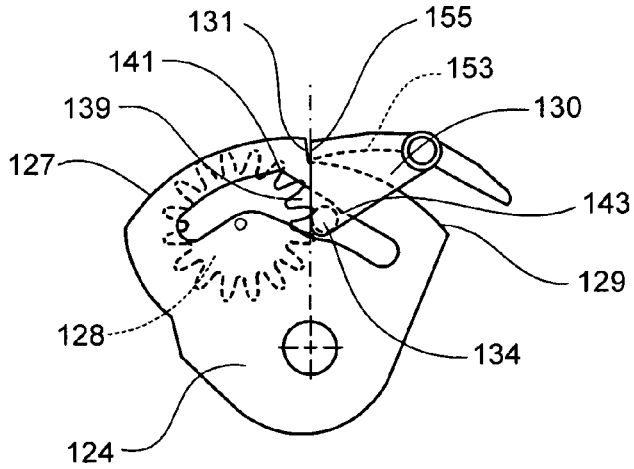
FIG. 5B is a view of the relative positions of the shuttle and trigger when the pick arm assembly is in the position shown in FIG. 5A.

Even with manipulation of the angle of the catch 140 in view of the coefficient of friction between the catch and the trigger 130, it is possible that the trigger may not drop down as explained above. This can be caused by debris or a damaged cam surface, for example. In anticipation of such an eventuality, the cam slot 126 in the shuttle 124 can be designed to engage with the follower pin 134 of the trigger 130 to pull the trigger down out of engagement with the catch. As discussed above with respect to FIG. 2, following the first bend 141 of the cam slot, the radius of curvature of the top edge 145 of the cam slot changes. Specifically, the radius of curvature of the slot gradually decreases from the location of the first bend until reaching the second bend 143. As the shuttle continues to rotate from the position shown in FIGS. 4A and 4B to the position shown in FIGS. 5A and 5B, if the trigger does not drop out of engagement, the changing radius of the top edge of the cam slot in the wider section 139 of the slot will pull the follower pin 134 downward, pivoting the trigger 130 about its pivot point 132, and causing the trigger to release from the catch 140. At this point the follower pin will have arrived at the second bend, as shown in FIGS. 5A, B. Since the rearward portion 137 of the cam slot is again substantially radial, though with a smaller radius than the forward portion 133 of the slot, it will hold the trigger in the released position, without imposing significant additional resistance upon the shuttle.

Figure 6A:
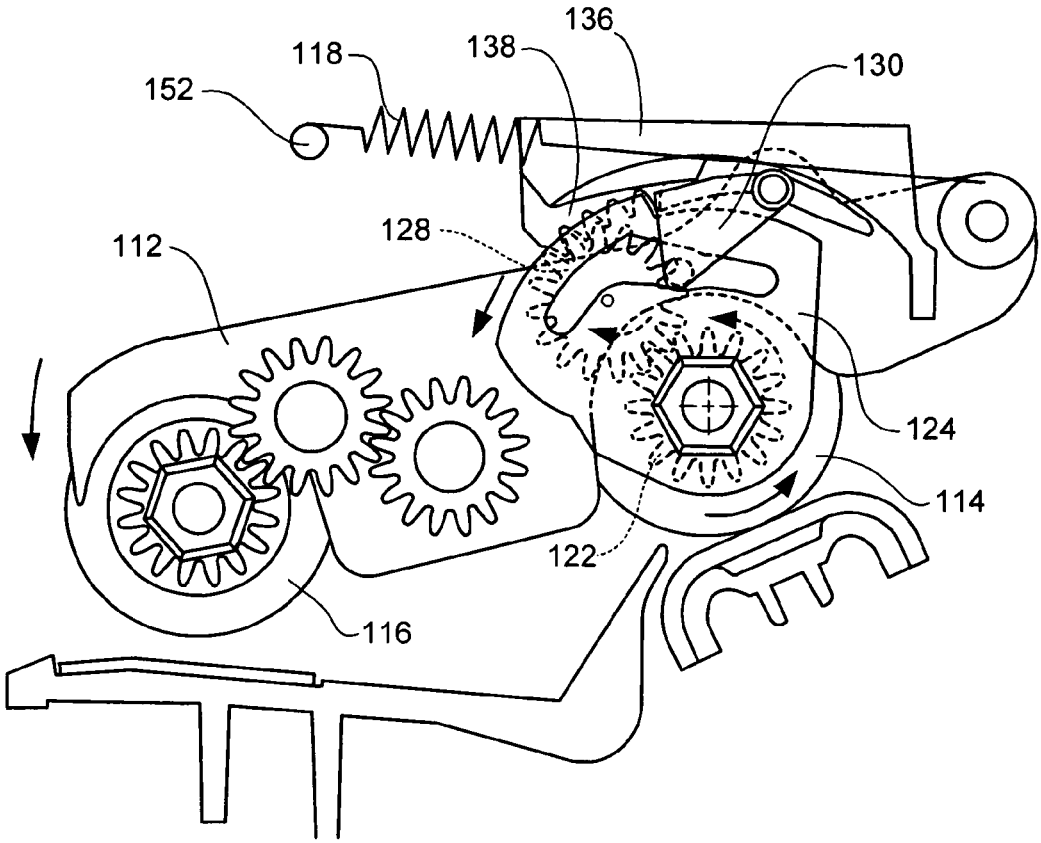
FIG. 6A is a side view of the pick arm of FIG. 1 with the planet gear engaged with the ring gear and the nose of the trigger pressing against the shuttle during the positive driving phase of either downward or upward motion.
Figure 6B:
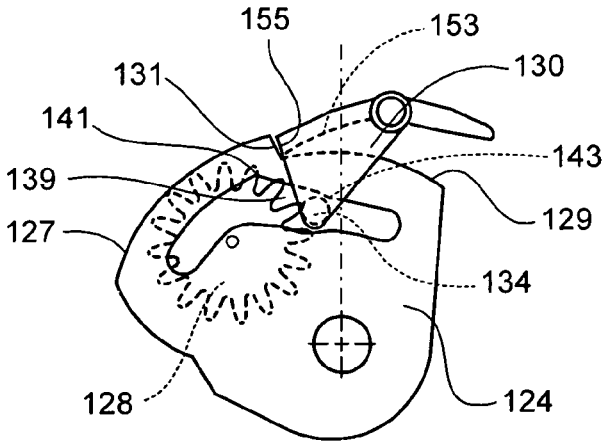
FIG. 6B is a view of the relative positions of the shuttle and trigger when the pick arm assembly is in the position shown in FIG. 6A.

Referring to FIGS. 6A and 6B, after the trigger 130 is released, the force of the tension spring 118 will tend to rotate the pick arm 112 counter clockwise, causing the nose 155 of the trigger to tend to stay pressed against the shoulder 131 of the shuttle 124. In this position the trigger (and the pick arm 112, to which the pivot 132 of the trigger is attached), will rotate in concert with the shuttle, thus allowing the rotation of the pick arm to follow the motion of the shuttle as it is positively driven down by the planet gear 128. In this phase of the pick arm motion, the pick arm and pivotal trigger can be said to "fall" down to catch up with the shuttle as it is positively driven down.

Given the arrangement of the planet gear 128 and the ring gear segment 138, the speed of rotation of the shuttle 124 will be less than the speed of rotation of the pick roller drive gear 122. The reduction in angular velocity of the shuttle is by a factor according to the following equation:

$$R=1+NR/Ns$$

where R is the reduction factor, NR is the number of teeth on the ring gear, and Ns is the number of teeth on the pick roller drive gear (a sun gear). In one embodiment of a pick arm like that shown in FIG. 1A, the ring gear can be a portion of a 50 tooth internal gear, and the pick roller drive gear and planet gear can be 16 tooth gears. Therefore:

$$R=1+50/16=4.125$$

For this example, the planetary gear arrangement provides a reduction gear factor of 4.125. In other words, the speed of rotation of the shuttle will be equal to the speed of rotation of the pick roller drive gear divided by 4.125. In addition to reducing the speed of rotation of the pick arm relative to the speed of rotation to the drive shaft, this reduction gear configuration also provides additional leverage that significantly reduces the torque needed from the drive shaft 120 to drive the shuttle 124 with its various cam surfaces.

Turning back to FIGS. 6A and 6B, with the trigger 130 released, the pick arm 112 is free to rotate counter-clockwise under the force of the tension spring 118 at the driven speed the planet gear. As the pick arm is driven downward, the pre-pick roller 116 can come into contact with media in the media tray 160. As noted above, the rotation of the pick arm will normally follow the motion of the shuttle 124 as it is positively driven down by the planet gear 128.

Figure 7A:
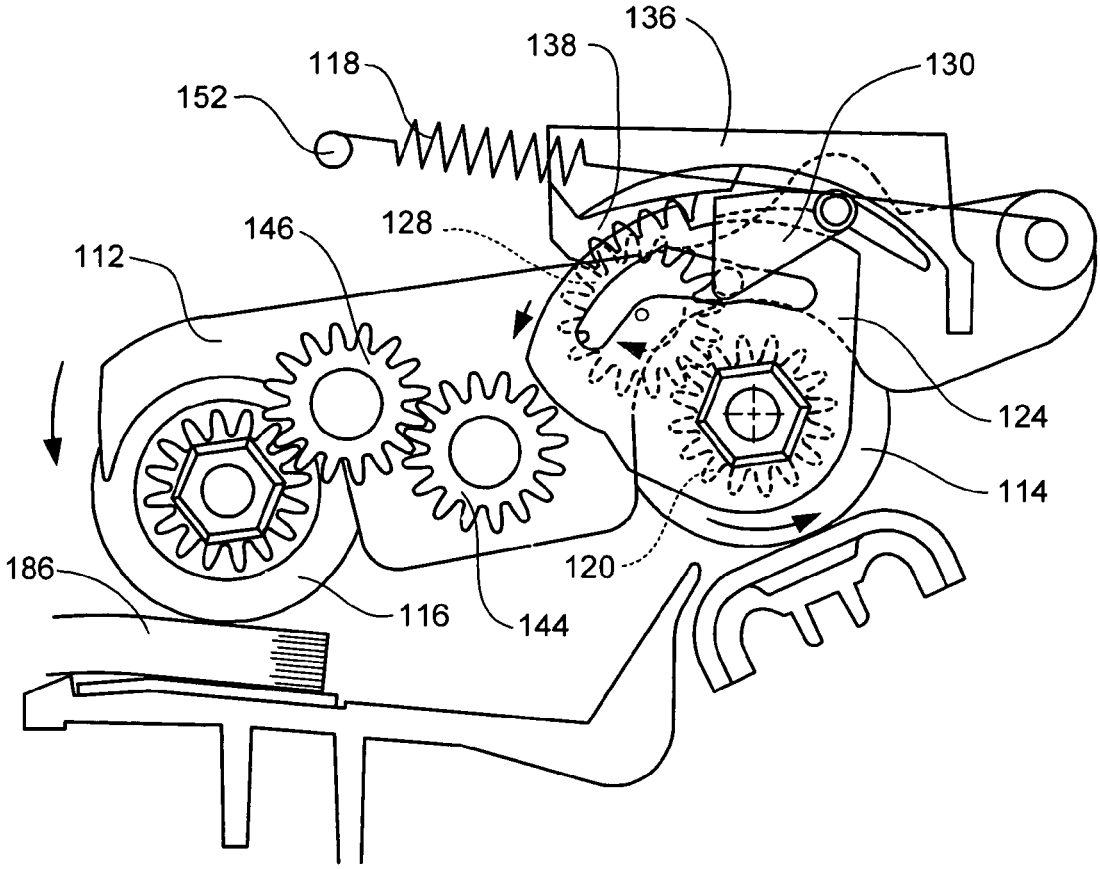
FIG. 7A is a side view of the pick arm of FIG. 1 with the pick arm rotated down to the pick position atop a stack of print media, with the planet gear still continuing its downward motion prior to engagement with the first idler gear.
Figure 7B:
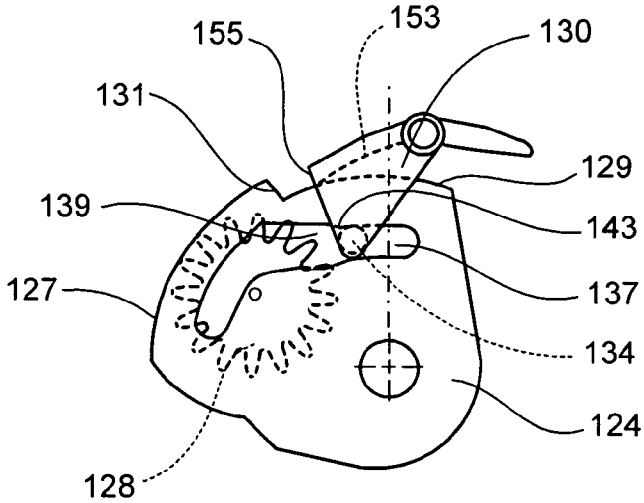
FIG. 7B is a view of the relative positions of the shuttle and trigger when the pick arm assembly is in the position shown in FIG. 7A.

As shown in FIGS. 7A and 7B, once the trigger 130 is released, the pick arm 112 can rotate and place the pre-pick roller 116 in contact with the top of a media stack 186 before the planet gear 128 engages with the pre-pick roller drive train, depending upon the thickness of the media stack. In this situation the planet gear continues to rotate in engagement with the ring gear 138 and the pick roller drive gear 122, causing the shuttle 124 to continue to rotate counterclockwise. This will cause the shoulder 131 of the shuttle to come out of contact with the nose 155 of the trigger (since the motion of the trigger will have stopped when the pick arm stopped rotating), and a space can open between these two structures. As the shuttle continues to rotate, the follower pin 134 will continue to slide within the rearward portion 137 of the cam slot 126. It will be apparent that in the portion of the sequence depicted in FIGS. 7A and 7B the pre-pick roller will not be rotating because the pre-pick roller gear train is not yet engaged.

Figure 8A:
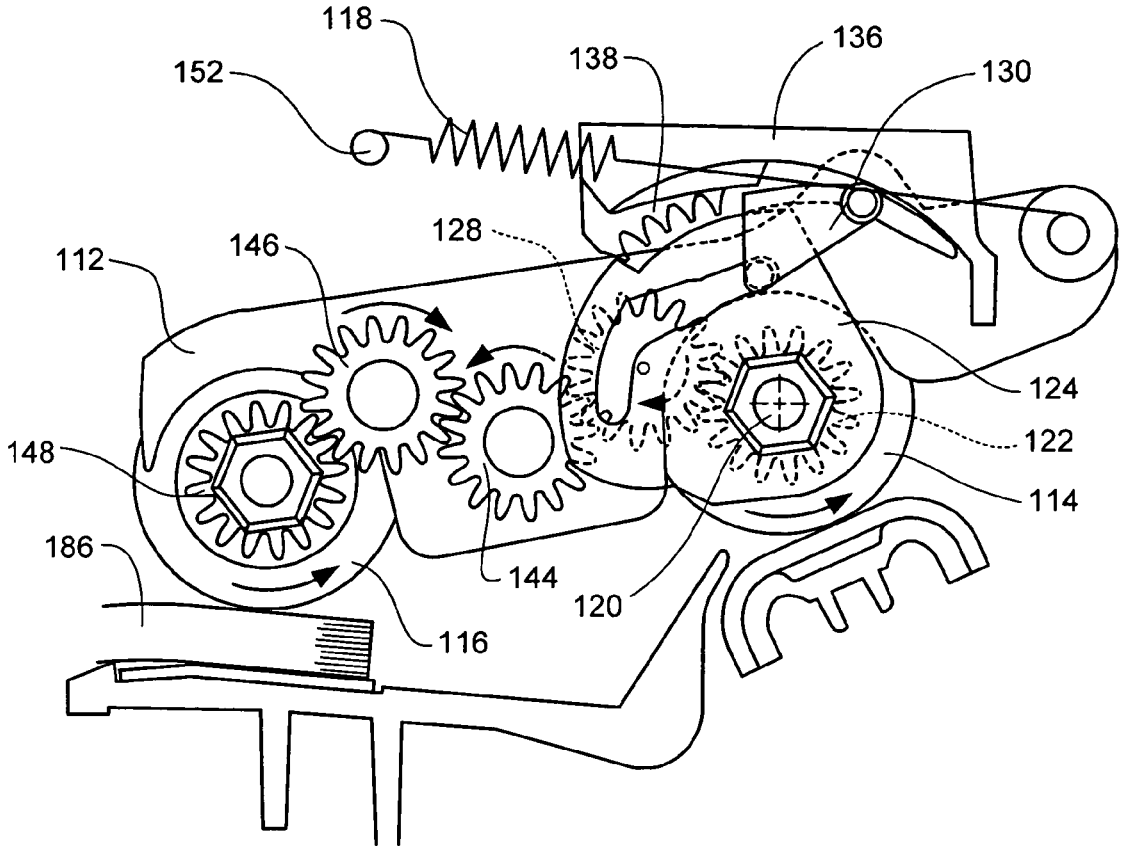
FIG. 8A is a side view of the pick arm of FIG. 1 with the pick arm rotated down in the pick position, and the planet gear engaged with the first idler gear and causing rotation of the pre-pick roller.
Figure 8B:
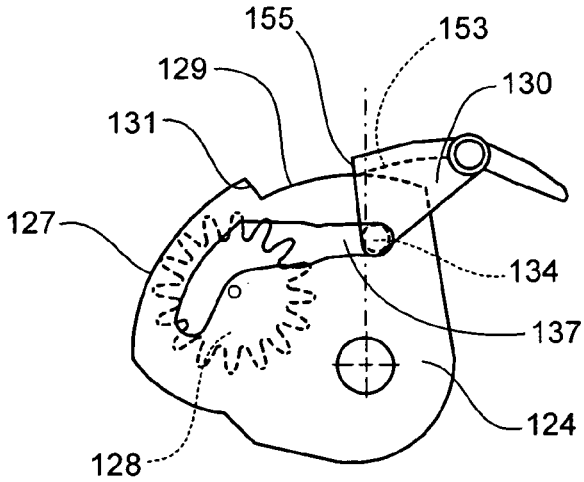
FIG. 8B is a view of the relative positions of the shuttle and trigger when the pick arm assembly is in the position shown in FIG. 8A.

With the pick arm 112 at the downwardly rotated position, the planet gear 128 will continue to rotate until it disengages from the ring gear segment 138. At that point friction between the drive shaft 120 and the shuttle 124 (as well as momentum of the shuttle) will cause the shuttle to continue to rotate until the planet gear arrives at the position at which it can engage the first idler gear 144. This condition is shown in FIGS. 8A and 8B. In the position shown in FIGS. 8A and 8B, the pick roller drive gear 122 is driven counter clockwise, and this rotation is transmitted through the planet gear 128 and the idler gears 144, 146, to the pre-pick roller drive gear 148 to drive the pre-pick roller 116 counter clockwise to pick a sheet of media from the stack 186. The paper pick and separation system thus utilizes the planet gear for two purposes: to positively drive the pick arm 112 down (and up, as discussed below), and to drive the pre-pick roller 116.

Figure 9A:
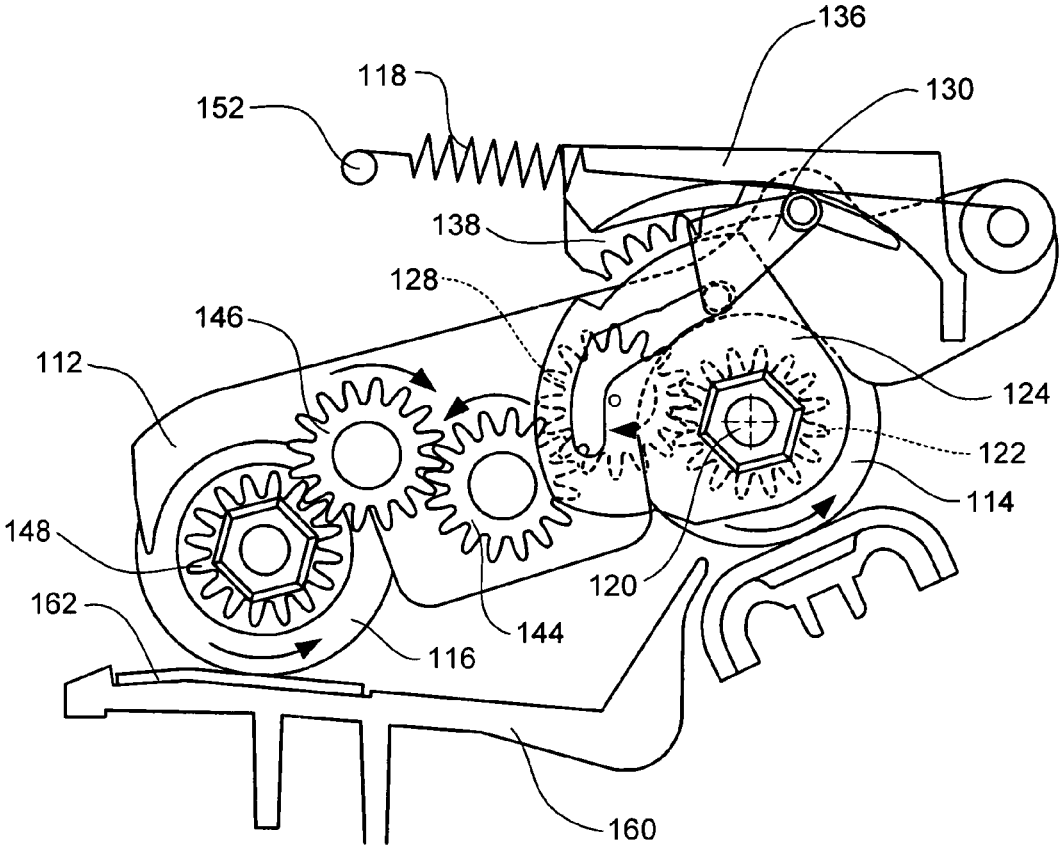
FIG. 9A is a side view of the pick arm of FIG. 1 with the pick arm rotated to the maximum downward position as for the last sheet of media, the planet gear being engaged to cause rotation of the pre-pick roller.
Figure 9B:
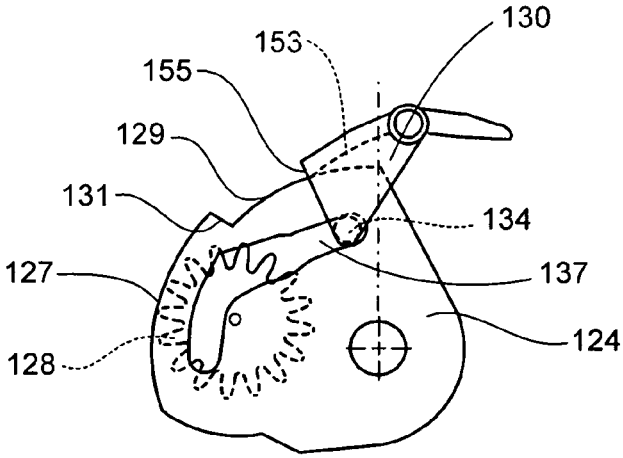
FIG. 9B is a view of the relative positions of the shuttle and trigger when the pick arm assembly is in the position shown in FIG. 9A.

Provided in FIG. 9A is a side view of the pick arm 112 fully down in the pick position with the drive train engaged, as in FIG. 8A, except that the input tray 160 is out of paper. In this position the pick arm has dropped fully and the pre-pick roller 116 is shown engaged with the cork pad 162. This position shows that the pick arm can easily drop far enough to pick one sheet of paper. As can be seen in the view of FIG. 9B, the trigger 130 and shuttle 124 are in the same positions relative to each other as in FIG. 8B, but both devices are rotated further because the entire pick arm is rotated further.

The shuttle 124 also includes a stop (not shown) to prevent the planet gear 128 from becoming over-engaged with the pre-pick gear train. That is, a pin, stop or barrier of some kind is positioned on the pick arm to physically limit the counter clockwise rotation of the shuttle, so that the teeth of the planet gear and first idler gear will not be forced too far into engagement, so that the respective gear teeth will engage properly without a danger of the gear teeth bottoming out. This ensures proper conjugate action and no binding.

The planet gear 128 can also function as an overdrive clutch. If the pre-pick roller 116 is overdriven, the planet gear will be driven up and out of engagement with the first idler gear 144. Overdriving of the pre-pick roller refers to a situation in which the print media, after having been picked and then captured and driven by scan rollers downstream of the pick system, is pulled at a rate that is faster than the rate of rotation of the pick roller and pre-pick roller. In this situation, friction between the media and the pre-pick roller will cause the pre-pick roller gear and the idler gears to rotate faster than the planet gear, thereby pushing the planet gear up and out of engagement with the first idler gear until the overdriven situation ceases (i.e. until the relative velocities of the pre-pick roller and planet gear equalize). At that point the input shaft 120, having a slight frictional drag on the shuttle 124, will drive the planet gear back into engagement with the pre-pick gear train.

When the desired sheets of media have been picked, the system can be reset by driving the input shaft 120 clockwise. The beginning of the reset process looks the same as the portion of the pick arm drop process shown in FIG. 6A, except that the direction of rotation of the components is the opposite of that shown, and the pick roller 114 will not rotate at all because of the directional clutch between the drive shaft and the pick roller. Other portions of the reset process are accurately depicted in FIGS. 5, 4 and 1, though again, the direction of rotation of the components in FIGS. 5 and 4 is the reverse of that shown, and the pick roller does not rotate when the drive shaft rotates clockwise.

Referring to FIG. 6A, when the drive shaft 120 is driven clockwise, friction between the drive shaft and the shuttle 124 will drive the shuttle clockwise, causing the planet gear 128 to disengage from the first idler gear 144 of the pre-pick drive train, and to move toward engagement with the ring gear segment 138. When clockwise rotation of the drive shaft commences, corresponding counter clockwise rotation of the planet gear will automatically drive the planet gear out of engagement with the first idler gear, thus preventing the pre-pick roller 116 from being driven backward.

After sufficient clockwise rotation of the shuttle 124, the planet gear 128 will engage the ring gear segment 138. Once the planet gear engages with the ring gear segment, the planet gear and shuttle will be in positive clockwise motion. At some point during this upward motion, the shoulder 131 of the shuttle will again come into contact with the nose 155 of the trigger 130, and the shuttle will begin to positively push the pick arm 112 upward. This is the condition shown in FIG. 6A. Since the trigger pivot 132 is attached to the pick arm, the force of rotation of the shuttle, which is driven by the planet gear, will rotate the pick arm up against the tension of the spring 118. At the same time, the follower pin 134 will also slide along the lower curved edge 147 of the cam slot 126, initially sliding in the rearward portion 137 of that slot.

During the upward rotation phase, the speed of rotation of the pick arm 112 will be the same as the rate of rotation of the shuttle 124. As noted above, the shuttle rotates at a fraction of the rotational speed of the input shaft, depending upon the reduction gear ratio between the planet gear 128 and the ring gear segment 138. The reduction gearing provided by the planet gear configuration is helpful during upward pick arm motion because the upward motion of the pick arm has to overcome the weight of the pick arm and the force of the tension spring 118. As noted above, in one embodiment the reduction gear ratio can be 1:4.125.

Continued rotation of the pick roller drive gear 122 in the clockwise direction causes the planet gear 128 to drive against the ring gear segment 138 and push upwardly upon the pick arm 112 until the trigger 130 reaches the engagement position with the catch 140. This is the position shown in FIG. 5A. The shoulder 131 of the shuttle 124, which pushes against the nose 155 of the trigger, can have an angle that is 15 degrees off from the line of action from the nose to the pivot 132 of the trigger. As explained above, this geometry should overcome the frictional forces between the trigger and shuttle shoulder, giving the trigger the tendency to pop up into the catch as the shuttle is driven past the edge of the catch.

During this phase of motion, the lower edge 147 of the central region 139 of the cam slot 126 will also press against the follower pin 134, and this pressure will also tend to push the trigger 130 up into the catch 140 to the engaged position, as shown in FIG. 4A. This ensures that the trigger is raised up into the catch in cases where any of the surfaces may be damaged, as discussed above.

Viewing FIG. 5A, as a fail-safe provision the trigger 130 can include a tail 157 that extends from the trigger pivot 132 on the opposite side from the trigger body 149. This tail is positioned to engage with a finger 190 that extends downward from the ring gear/latch assembly 136. If, for any reason, the trigger does not "pop" upwardly from the shuttle shoulder 131 and into the catch as described above, this tail will contact the finger during continued clockwise rotation of the pick arm, which contact will force the trigger into the latched or cocked position. The trigger will then be engaged against the spring force to keep the pick arm 112 up.

Upon re-engagement of the trigger 130, as shown in FIG. 4A, the planet gear 128 will still be engaged with the ring gear segment 138, and the shuttle 124 will thus continue to rotate clockwise. This allows the outer cam surface 127 of the shuttle to slide under the shoulder 151 of the trigger to lock the trigger in the engaged position. Rotation of the shuttle will then continue briefly until the planet gear rotates clear of the ring gear segment, after which the shuttle will continue to rotate briefly due to friction with the drive shaft 120, until the shoulder 131 of the shuttle abuts against the mating stop surface (not shown) of the trigger. The continued clockwise rotation of the shuttle moves the planet gear clear of the ring gear, and returns the pick arm assembly to the freewheeling position shown in FIG. 1A. As noted above, this freewheeling position provides a dwell period of indefinite duration, in which the drive shaft can spin clockwise without causing motion of the pick arm or the pre-pick roller. Once the pick arm is fully up, there is a relatively small amount of parasitic torque on the system (between the shuttle and the drive shaft).

With the paper pick system described herein, the pre-pick normal force is developed by the extension spring 118, which allows the normal force to be more consistent throughout the range of motion of the pick arm—whether the media stack is large or a single sheet. Free body diagrams of the pick arm assembly are provided in FIGS. 10A and 10B, and help illustrate this feature. Viewing FIG. 10A, since the location of the attachment point 152 of the tension spring 118 is fixed with respect to the position of the drive shaft 120, but the tension spring is attached to the rear extension 154 of the pick arm 112, the moment arm associated with the spring force $F_s$ will vary as the angle a of the pick arm changes.

Figure 10A:
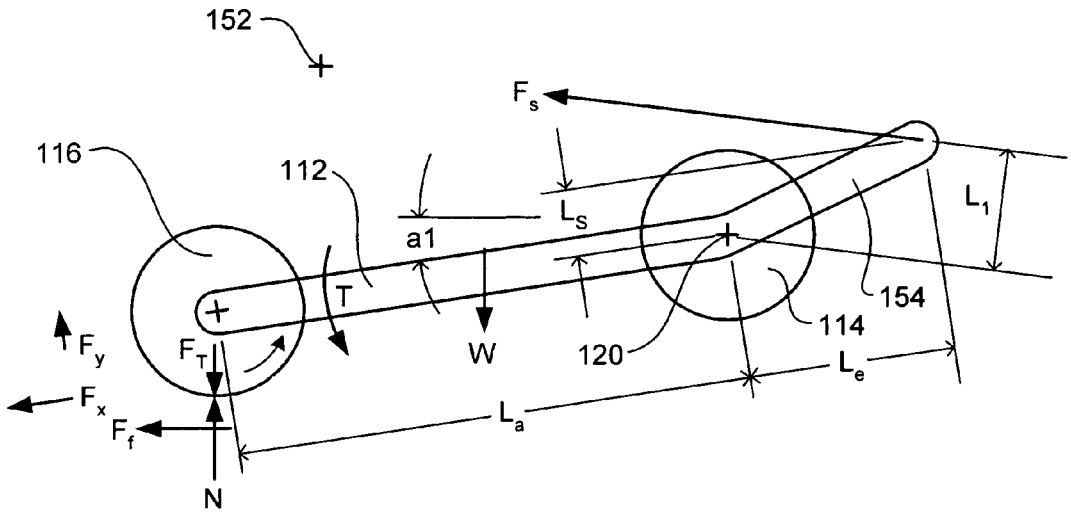
FIG. 10A is a free body diagram of a pick arm of a paper pick and separation system in accordance with the present disclosure, with the pick arm in the raised and disengaged position as in FIG. 1.
Figure 10B:
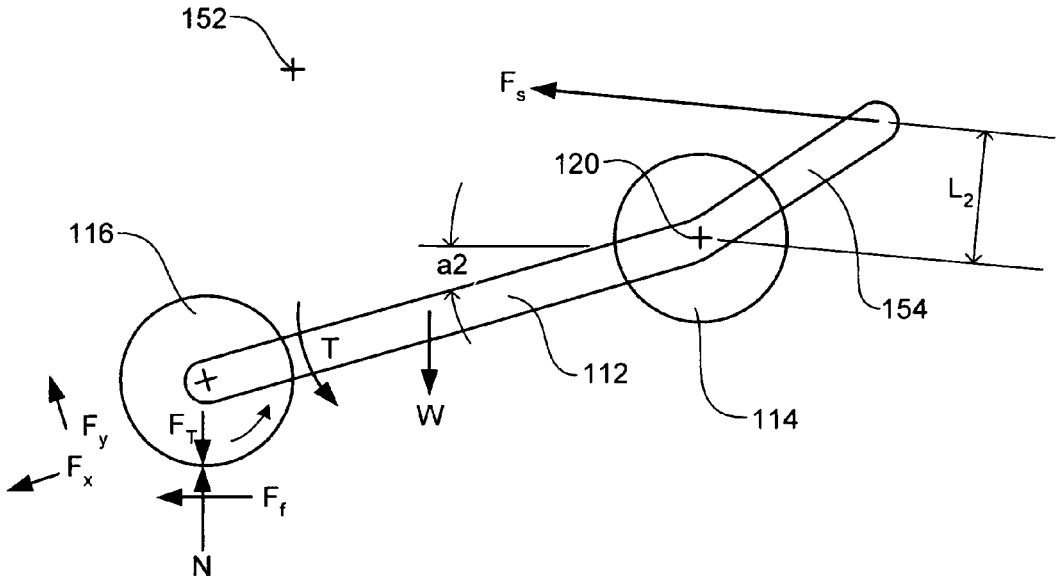
FIG. 10B is a free body diagram of a pick arm of a paper pick and separation system in accordance with the present disclosure, with the pick arm in the lowered and engaged position as in FIG. 8.

This is apparent by comparing FIG. 10A with FIG. 10B. In FIG. 10A, where the pick arm 112 is rotated a relatively small deflection angle a1, the moment arm has length $L_1$. In FIG. 10B, where the pick arm is rotated to a deflection angle a2 that is larger than angle a1, the moment arm has length $L_2$, which is larger than $L_1$.

As is well known, the force provided by a spring also varies depending upon the magnitude of displacement (i.e. stretching or compression) of the spring. Since the spring 118 is held in tension throughout the entire range of motion of the pick arm, it will be apparent that counter clockwise rotation of the pick arm will reduce the displacement of the spring, which will therefore reduce its tensile force. However, this reduction in spring force can be more than offset by the change in the effective length $L_x$ of the moment arm to which the spring is attached. Due to the geometry of the rear extension 154 of the pick arm and the position of the spring attachment point 152, the length of the moment arm associated with the spring will increase as the pick arm rotates downwardly, as mentioned above. Thus, while the tensile force of the spring will decrease slightly with counter clockwise rotation of the pick arm (as suggested by the relative sized of the spring force vectors $F_s$ in FIGS. 10A and 10B), the moment arm will lengthen, allowing the torque T provided by the spring to remain fairly constant. While a tension spring is used in the illustrated embodiment, it will be apparent that the pick arm assembly could be configured with a compression spring. Moreover, many other arrangements for biasing the pick arm toward the downwardly rotated pick position could also be provided.

The geometry of the pick arm 112 can also allow the torque to vary to offset the increasing counter force $F_y$ due to frictional resistance upon the media. The normal force N is equal to the portion of the weight W of the pick arm that is borne by the pre-pick roller, plus the downward force FT that is produced by the torsional force T imposed upon the pick arm by the spring 118. As shown in FIG. 10A, at a shallow pick arm deflection angle a1, the component of force $F_y$ that tends to cause upward rotation of the pick arm is relatively small. However, at a larger pick arm deflection angle a2, shown in FIG. 10B, the force $F_y$ will be larger, as suggested by the relative size of the respective vectors. However, with a lengthening moment arm (lengthening from $L_1$ to $L_2$), the spring force can provide an increasing torque T, which can oppose this increased counteractive force, thus keeping the normal force more constant.

The inventors have selected certain design dimensions and other parameters for one embodiment of a pick arm in accordance with the present disclosure. Viewing FIG. 10A, the inventors have produced a pick arm wherein the length of the pick arm $L_a$, measured from center to center of the pick roller and pre-pick roller is 31.4 mm, and the length of the pick arm extension $L_e$, measured from the center of the pick roller to the point of attachment of the spring, is 21 mm. The attachment point of the spring is also elevated above the centerline of the pick arm by a distance of $L_s$ of 16.3 mm. In this embodiment the angular deflection a of the pick arm ranges from 0 to 16 degrees relative to the horizontal, and the force $F_s$ provided by the spring ranges from 1.9 to 2.3 Newtons.

Figure 11:
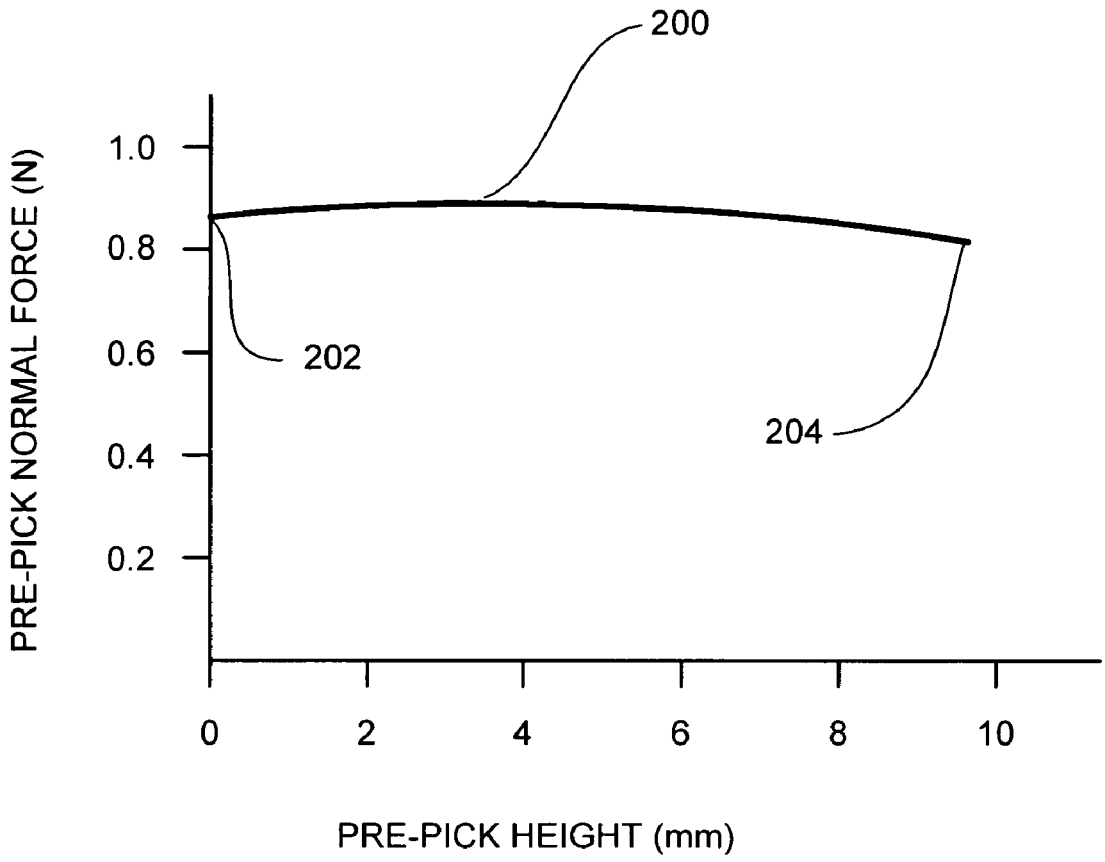
FIG. 11 is a graph of pre-pick roller normal force versus height of the pre-pick roller for the pick arm of FIG. 1.

With these parameters, the normal force N imposed upon the media stack is relatively constant. Provided in FIG. 11 is a graph of pre-pick roller normal force versus angular deflection for a pick arm configured with the dimensions given above. This graph shows the force (in Newtons) on the pre-pick roller for various pre-pick stack heights up to almost 10 mm (representing about 100 sheets of 201*b* printer paper). As can be seen from this graph, as the extension spring pulls the pick arm counter clockwise, the force curve 200 is relatively flat. With a media stack height of zero, at the point labeled 202, the normal force is about 0.86 N. With a media stack height of about 9.5 mm, at the point 204 at the far right end of the curve, the pre-pick normal force is about 0.82 N. The peak normal force is about 0.87 N. It will be apparent from this graph that the normal force is very consistent over the entire range of stack heights. This means that there will be a relatively constant normal force from the first sheet in the stack to the last.

The paper pick and separation system disclosed herein thus uses a gear drive and latch system that (1) rotates to hold the pick arm in a disengaged position, and (2) disengages to allow the pick arm to rotate to an engaged position under the force of a tension spring that is attached to the pick arm. The orientation of the spring and its connection to the pick arm causes the torque applied to the pick arm to increase as the deflection angle of the pick arm increases, so as to offset decreasing tension of the spring and increasing torque-induced counter-rotational force from friction between the pre-pick roller and the input stack. This configuration causes the pick arm to impart a substantially constant normal force on the media regardless of the height of the input stack, providing more reliable picking of media. The inventors have found that this system gives good paper pick and separation performance, it is low cost in terms of both parts and system cost, and provides a small size system without sacrificing performance.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A media pick system for a printing device, comprising:

a rotatable pick arm, having a pick roller and a pre-pick roller attached thereto;

a biasing member, attached to the pick arm, configured to bias the pick arm toward an engaged position of the pre-pick roller with a stack of print media with a biasing force of the biasing member to the pick arm that only increases as a deflection angle of the pick arm increases; and a drive system, configured to selectively (1) cause the pick arm to rotate in a first direction to the engaged position, and (2) rotate the pick arm in a second direction against the force of the biasing member to a disengaged position, wherein the drive system comprises:

a drive shaft, associated with the pick roller, configured to provide driving power to the media pick system;

a pre-pick roller drive train, interconnecting the pick roller and the pre-pick roller; and a planet gear, engaged with the pick roller, selectively moveable between a position of engagement with the pre-pick roller drive train, and a position of disengagement from the pre-pick roller drive train.

2. A system in accordance with claim 1, wherein the drive system further comprises:

a shuttle, slidingly rotatably attached to the drive shaft, the planet gear being rotatably attached to the shuttle; and a ring gear segment, centered about the drive shaft and configured to engage the planet gear and cause rotation of the shuttle to selectively move the planet gear toward or away from the position of engagement.

3. A system in accordance with claim 2, wherein the drive system further comprises a latch, having an unlocked position allowing rotation of the pick arm in the first direction, and a locked position substantially preventing rotation of the pick arm from the disengaged position; and wherein the shuttle further comprises a cam surface, configured to urge the latch toward the locked position.

4. A system in accordance with claim 3, wherein the shuttle further comprises:

a shoulder, defining a recess configured to allow the latch to drop to the unlocked position, and configured to press against the latch, such that a direction and speed of rotation of the pick arm is dependent upon a direction and speed of rotation of the planet gear.

5. A system in accordance with claim 3, further comprising:

a cam slot in the shuttle, having a curved surface of variable radius; and a pin, attached to the latch and positioned to slidingly ride in the cam slot, the cam slot having an upper surface configured to urge the latch away from the locked position when the shuttle rotates in a first direction, and a lower surface configured to urge the latch toward the locked position when the shuttle rotates in a second direction.

6. An actuation system for use with a pick arm having a pre-pick roller, comprising:

a spring, attached to the pick arm, configured to bias the pick arm toward an engaged position with a stack of print media, with a biasing force of the spring to the pick arm that only increases as a deflection angle of the pick arm increases;

a latch, attached to the pick arm, having an unlocked position, and a locked position wherein motion of the pick arm is substantially prevented;

a rotatable cam member, having a cam surface configured to urge the latch toward the locked position; and a gear drive system, configured to (1) drive the rotatable cam member to selectively lock and unlock the latch, and (2) engage and drive the pre-pick roller when the latch is unlocked and the pick arm is rotated to the engaged position.

7. An actuation system in accordance with claim 6, wherein the gear drive system further comprises:

a pre-pick gear train, associated with the pre-pick roller; and a drive gear train, configured to drive the cam member between a fully up position, wherein the pre-pick gear train is disengaged, and a fully down position, wherein the pre-pick gear train is engaged.

8. A system in accordance with claim 7, wherein the drive gear train further comprises:

a planet gear, rotatably attached to the cam member, configured to drive the cam member between the fully up position and fully down positions and to engage the pre-pick gear train when the cam member is rotated to the fully down position; and a ring gear segment, configured to engage the planet gear and cause rotation of the cam member during at least a portion of the motion between the fully up and fully down positions.

9. A system in accordance with claim 6, wherein the rotatable cam member further comprises a recess, suitable to receive the latch in the unlocked position.

10. A system in accordance with claim 9, wherein rotatable cam member further comprises a shoulder, configured to press against the latch, such that a direction and speed of rotation of the pick arm is dependent upon a direction and speed of rotation of the cam member.

11. A printing device, comprising:

a rotatable pick arm, having a pick roller and a pre-pick roller attached thereto;

a biasing member, attached to the pick arm, configured to bias the pick arm toward an engaged position of the pre-pick roller with a stack of print media, providing a normal force of the pre-pick roller upon the stack of print media that is substantially constant throughout a range of deflection of the pick arm;

a drive system, configured to selectively (1) cause the pick arm to rotate in a first direction to the engaged position, and (2) rotate the pick arm in a second direction against the force of the biasing member to a disengaged position, wherein the drive system comprises:

a latch having an unlocked position allowing rotation of the pick arm in the first direction and a locked position substantially preventing rotation of the pick arm from the disengaged position;

a rotatable cam member having a cam surface, configured to urge the latch toward the locked position;

a planet gear, rotatably attached to the cam member, configured to drive the cam member between a fully up position and a fully down position, and to engage a gear train, interconnected between the pick roller and the pre-pick roller, so as to engage the pre-pick roller, when the cam member is rotated to the fully down position; and a ring gear segment, configured to engage the planet gear and cause rotation of the cam member during at least a portion of the motion between the fully up and fully down positions.

12. A printing device in accordance with claim 11, wherein the biasing member comprises a spring, attached to the pick arm at a moment arm that increases in length as a deflection angle of the pick arm toward the engaged position increases.

* * * * *